United States Patent [19]

Hübler

[11] Patent Number: 4,536,725

[45] Date of Patent: Aug. 20, 1985

[54] STRIPLINE FILTER

[75] Inventor: Bodo-Hagen Hübler, Backnang, Fed. Rep. of Germany

[73] Assignee: Licentia Patent-Verwaltungs-G.m.b.H., Frankfurt am Main, Fed. Rep. of Germany

[21] Appl. No.: 436,038

[22] Filed: Oct. 22, 1982

[30] Foreign Application Priority Data

Nov. 27, 1981 [DE] Fed. Rep. of Germany ..... 3147055
Nov. 27, 1981 [DE] Fed. Rep. of Germany ... 8134636[U]

[51] Int. Cl.[3] ..... H01P 1/203; H01P 7/08; H01P 3/08; H01P 5/18

[52] U.S. Cl. ..... 333/204; 333/202; 333/116; 333/246

[58] Field of Search ..... 333/1, 100, 101, 109–113, 333/115–117, 125–129, 219, 202–208, 246; 455/198, 281, 282, 307, 325, 327, 111, 124; 330/53–56; 329/160–162; 331/77

[56] References Cited

U.S. PATENT DOCUMENTS

| | | | |
|---|---|---|---|
| 3,451,015 | 0/1969 | Heath | 333/204 X |
| 3,659,205 | 4/1972 | Cooke et al. | 455/198 |
| 4,158,184 | 6/1979 | Kenyon | 333/109 X |
| 4,494,086 | 1/1985 | Dydyk | 333/204 X |

FOREIGN PATENT DOCUMENTS

| | | |
|---|---|---|
| 1926501 | of 1970 | Fed. Rep. of Germany . |
| 2202595 | of 1973 | Fed. Rep. of Germany . |
| 1926501 | 12/1974 | Fed. Rep. of Germany . |
| 579414 | of 1946 | United Kingdom . |
| 579414 | 8/1948 | United Kingdom . |

OTHER PUBLICATIONS

Wenzel–"Exact Design of TEM Microwave Networks using Quarter Wave Lines", IEEE Trans. on Microwave Theory and Techniques, Jan. 1964; pp. 94–111.

IEEE "1980 IEEE MTT-S International Microwave Symposium Digiest," pp. 477–479, 1980 *The Institute of Electrical & Electronics Engineers.*

Fechner, "Microstrip Elliptic Function Bandpass Filters," pp. 79–80, vol. 34 (1980) No. 3, *Cauer-parameter-Bandpasse in Mikrostreifenleiter-Technik.*

Rehnmark, "Meander-Folded Coupled Lines," pp. 225–231, Apr. 4th, 1978, *IEEE Transactions on Microwave Theory and Techniques,* vol. MTT-26, No. 4.

Rizzoli, "Analyais and Design of Microstrip DC Blocks," pp. 109–110, vol. 20, No. 6, Jun. 1977 *Microwave Journal.*

*Primary Examiner*—Marvin L. Nussbaum
*Attorney, Agent, or Firm*—Spencer & Frank

[57] ABSTRACT

A stripline filter having at least two tuned striplines and a directional stripline coupler wherein the coupling path of the directional stripline coupler is located in the signal path between the input and output terminals of the filter. The stripline filter comprises an insulating substrate having a ground conductor affixed thereto and at least two tuned stripline resonators secured to the substrate, the resonators being electrically connected to the ground conductor. The tuned striplines resonate at one-quarter of the wavelength corresponding to the operating frequency of the filter. The directional stripline coupler consists of a pair of spaced conductors, at least one of which forms a part of one of the tuned striplines. The electrical length of the directional stripline coupler is substantially less than the total length of a tuned stripline conductor.

16 Claims, 6 Drawing Figures

STRIPLINE FILTER

BACKGROUND OF THE INVENTION

The present invention relates to a stripline filter and, in particular, to a stripline filter having at least two tuned striplines and a directional stripline coupler located in the signal path between the input and output of the filter.

A stripline filter of this type is described in U.S. Pat. No. 3,659,205 wherein the filter is disposed between the input of a UHF tuner and a mixer diode. It is impractical in this known stripline filter to provide trimming capacitors for tuning the two tuned striplines. Moreover, if this known filter arrangement is used to transfer large amounts of power or handle lower operating frequencies, without the use of additonal trimming components, the resulting dimensions become unduly large.

It is known to reduce the dimensions of low pass stripline filters by folding the conductors which have the effect of inductances, the distances between the folds being selected so that the folds do not have an electrical effect on the filter or so that the intentionally selected small distances have defined electrical effects. Such devices are disclosed in British Pat. No. 579,414 and in German Auslegeschrift No. 1,926,501 respectively.

However, the folding of striplines acting as inductances is not sufficient to solve the problem to which the present invention is directed, particularly since striplines which act only as inductances are not usually employed in stripline filters having tuned striplines.

Accordingly, it is an object of the present invention to provide a stripline filter having dimensions which are as small as possible and to make the use of trimming components unnecessary.

SUMMARY OF THE INVENTION

In accordance with the present invention, a stripline filter is provided having at least two tuned striplines and a directional stripline coupler wherein the coupling path of the directional stripline coupler is located in the signal path between the input and output terminals of the filter. The stripline filter comprises an insulating substrate having a ground conductor affixed thereto and at least two tuned stripline resonators secured to the substrate, the resonators being electrically connected to the ground conductor. The tuned striplines resonate at one-quarter of the wavelength corresponding to the operating frequency of the filter. The directional stripline coupler consists of a pair of spaced conductors, at least one of which forms a part of one of the tuned striplines. The electrical length of the directional stripline coupler is substantially less than the total length of a tuned stripline conductor.

The invention is based on the following considerations:

In conventional stripline filters having tuned striplines as resonators, the coupling of the resonators is distributed over the entire length of the resonators. This has the disadvantage that the distances between the resonators must be relatively large, for example, larger than the width of a conductor and with a relative bandwidth of less than 30%. With large distances between the resonators, the stray fields acting on the coupling are correspondingly large so that conductor sections which are not coupled must be placed relatively far away.

In contrast, in the stripline filter of the present invention, the coupling is limited to small sections of the resonators which leads to short distances in the coupling region. Consequently, low stray fields exist in the vicinity of the coupling zones and therefore better space utilization of the areas adjacent the coupling zones is realized because conductors which are not coupled can be moved closer to the coupling zones. Moreover, it is possible to fold the coupling structures since coupling zones of approximately the same electrical length lie opposite one another. Otherwise, with large gap widths, the difference between the electrical lengths would be too large.

DETAILED DESCRIPTION OF THE PREFERRED EMBODIMENTS

Figure 1:
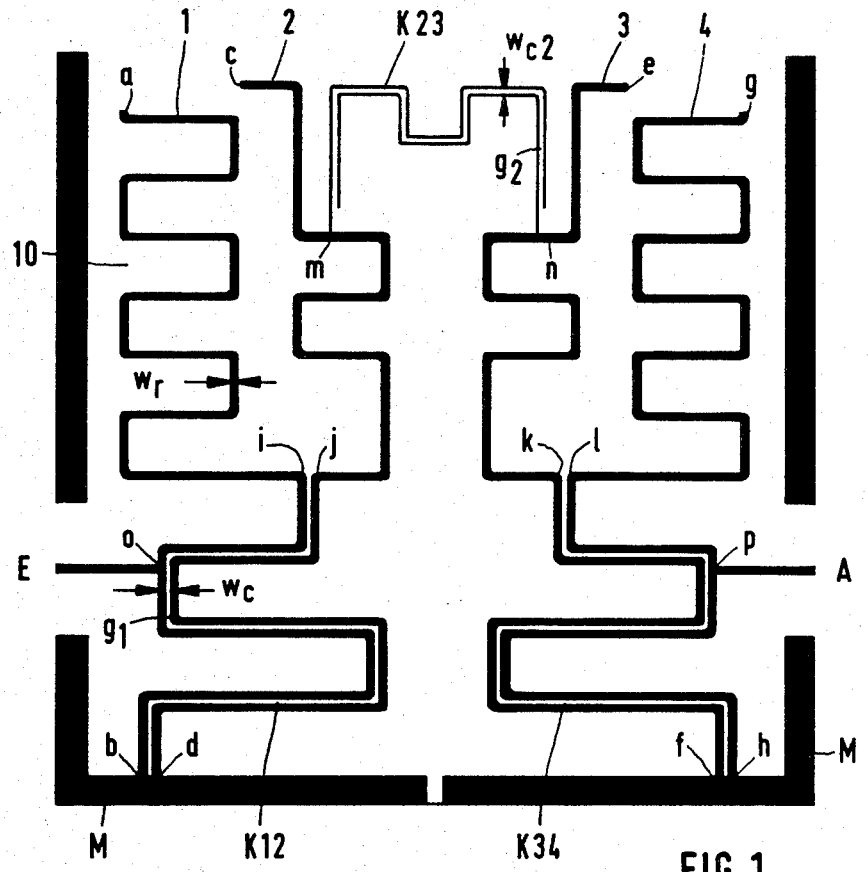
FIGS. 1 and 3 show two different embodiments of the invention on a ceramic substrate.
Figure 2:
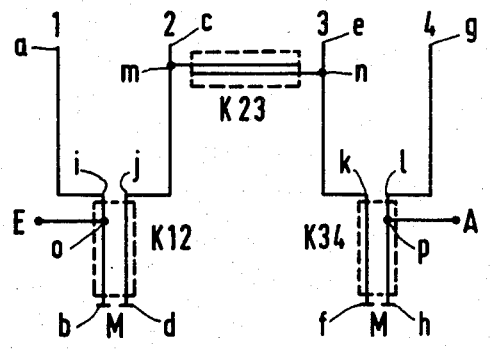
FIGS. 2 and 4 are equivalent circuit diagrams for the embodiments of FIGS. 1 and 3 respectively.

Referring to FIGS. 1 and 2, there is shown a thin film stripline filter for operation at a frequency of 222 MHz having four tuned stripline resonators 1, 2, 3 and 4 affixed to the surface of a 2"×2" ceramic substrate 10 and electrically connected at one end to a conductive strip M on the substrate. Strip M is maintained at a reference or ground potential. The length of resonator 1, which is an open tuned conductor, between the points a and b is one-quarter wavelength $\lambda$ at a pole frequency of the stripline filter. The other three resonators 2, 3 and 4 are also open tuned conductors and having a length between points corresponding to points a and b on resonator 1 which are equal to $\lambda/4$ at a pole frequency of the filter. That is, the total length of each of conductor 2 between points c and d, conductor 3 between points e and f and conductor 4 between points g and h is $\lambda/4$.

The portions of resonators 1 and 2 between points i-b and j-d respectively is a directional stripline coupler $K_{12}$ which has a characteristic impedance Z. Similarly, the portions of resonators 3 and 4 between points k-f and l-h is a directional stripline coupler $K_{34}$ having a characteristic impedance Z. The coupling between the resonators 2 and 3 is effected by a directional stripline coupler $K_{23}$ between points m and n which also has a characteristic impedance Z. An input terminal E is connected to resonator 1 at point O and an output terminal A is connected to resonator 4 at point P.

The directional resonator and stripline coupling structures are folded several times, as indicated by their zig-zag configurations. The stripline filter does not require equalization because the mechanical tolerances of the thin film circuit are so small that their influence on its electrical properties is insignificant.

Designating the width of a resonator conductor as $w_r$, and the gap between conductors and the coupler portion as $g_1$, the maximum coupler width $w_c=2w_r+g_1$, is made less than 2.5 $w_r$. The relative bandwidth is 27% and the greatest length of directional stripline couplers $K_{12}$, $K_{23}$ and $K_{34}$ is less than $\lambda/8$ at the operating frequency of 222 MHz . Also, the electrical length of one of the conductors of a directional stripline coupler, such as the portion i-b, is less than the product of the bandwidth and twice the electrical length of stripline resonator 1.

Figure 3:
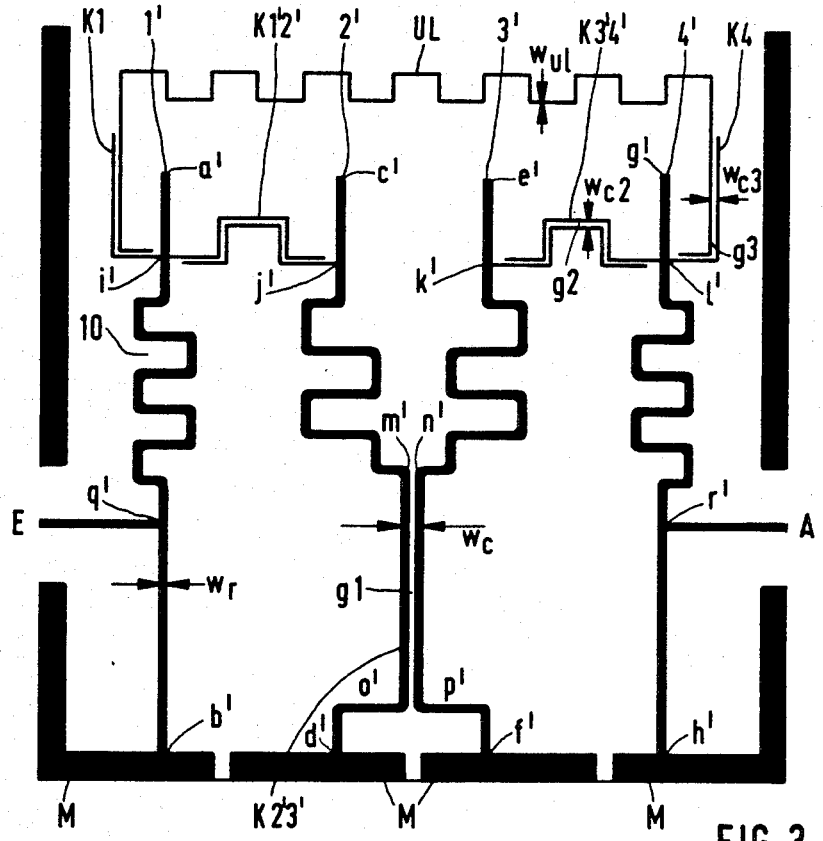
Figure 5:
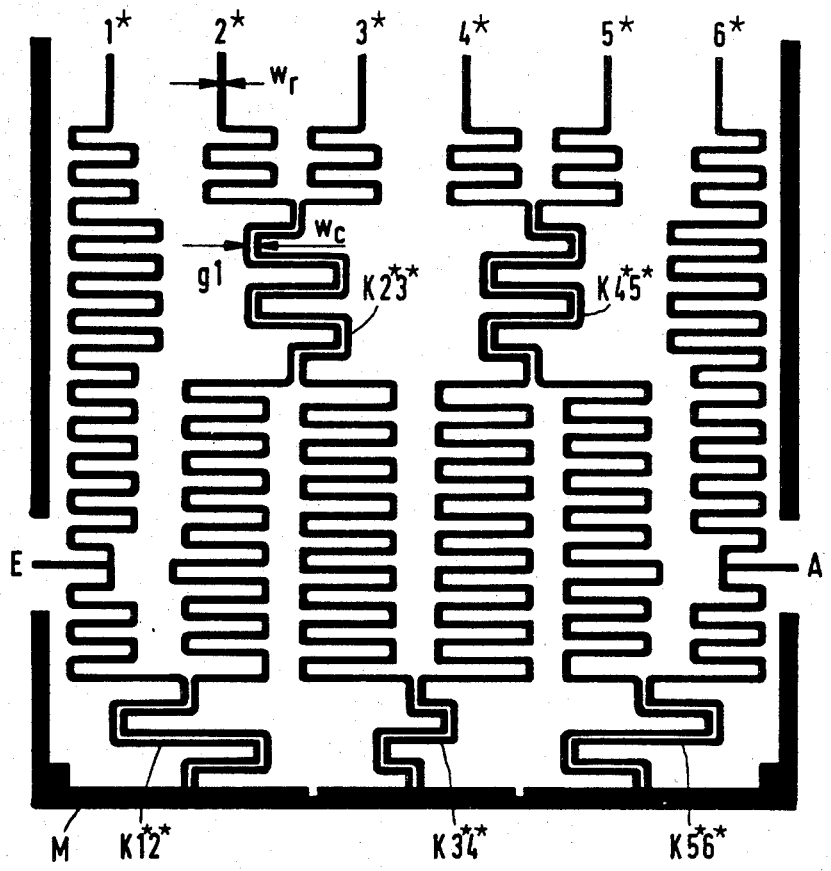
FIG. 5 shows a third embodiment of the invention on a barium tetratitanate substrate.

The proceeding with the design of all the filters shown in FIGS. 1, 3, and 5 is the following.

First it is to design a filter with lumped elements (L, C) which form resonant circuits so that they realize the desired filter characteristic. This lumped element filter can be transposed to an equivalent TEM microwave network using coupled striplines as described in IEEE Transactions on Microwave Theory and Techniques, Jan. 1964, pp. 94–111.

The herein described filter is composed of stripline resonators which are coupled over their whole length. This requires a relative large spacing between the coupled resonators. For that reason it isn't possible to fold the resonators and therefore the dimensions of such a filter becomes unduly large.

Now according to the invention stripline resonators are chosen which have only short zones serving as directional couplers. This makes it possible to reduce the spacing between the coupled conductor sections. After defining the spacing between the coupled conductor sections and the width of this conductor sections the electrical parameters of these couplers are determined for instance by a mathematic method which is described in IEEE Transactions on Microwave Theory and Techniques, Vol. MTT-19, No. 5, May 1971. When the coupler parameters are known, all other dimensions of the filter can be determined so that the filter has the desired characteristic.

For to fulfil the requirements (filter dimensions as small as possible, optimal electrical filter properties) the form of the filter, i.e. the foldes of the resonators and couplers, and all data respecting the maximum length of the coupler zones, the maximum width of the coupled conductors and the spacing between them are experimentally optimized by aid of a calculator.

By this way for the filter shown in FIG. 1 the following optimal filter dimensions have been arised. The width $w_r$ of the resonator conductors is 0.6 mm, the couplers $K_{12}$ and $K_{34}$ have a width $w_c=1.4$ mm and a gap width $g_1=0.22$ mm and the coupler $K_{23}$ has a width $w_{c2}=0.804$ mm and a gap width $g_2=0.124$ mm. The carrier substrate of this filter structure has a relative dielectric constant of 9.8 and a thickness of 25 mil.

Figure 4:
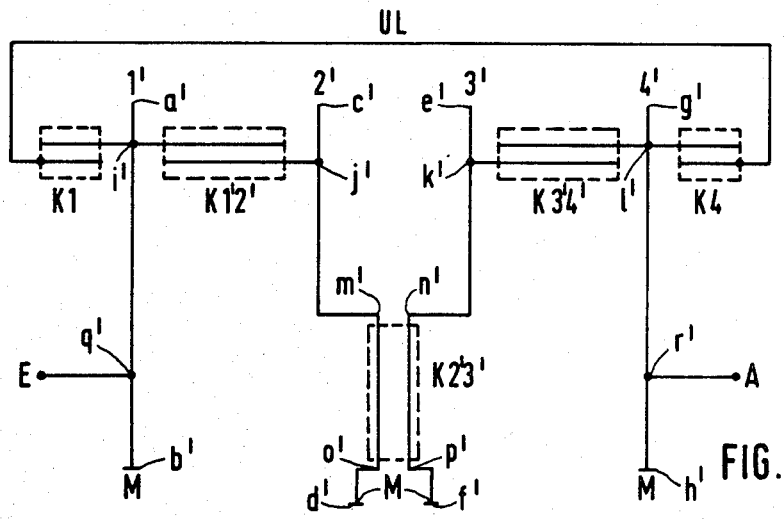

FIGS. 3 and 4 show a four-circuit stripline filter suitable for operation at 410 MHz. The lengths of the resonators 1', 2', 3' and 4' between points a'-b', c'-d', e'-f' and g'-h' respectively are one-quarter wavelength and the widths of the conductors is designated $w_r$, as in FIG. 1.

Coupling between resonators 1' and 2' is effected by a directional stripline coupler $K_{1'2'}$ connected to resonators 1' and 2' at points i' and j', and coupling between resonators 3' and 4' is effected by a directional stripline coupler $K_{3'4'}$ connected to resonators 3' and 4' at points k' and 1'. Coupling between resonators 2' and 3' is realized by a directional coupler $K_{2'3'}$ comprising those parts of the conductors of resonators 2' and 3' which extend between points m'-o' and n'-p' respectively. Each of the directional couplers $K_{1'2'}$, $K_{3'4'}$ and $K_{2'3'}$ has a characteristic impedance Z. An input terminal E is connected to resonator 1' at point q' and an output terminal A to resonator 4' at point r'.

One end of a bypass line UL is coupled to point i' of resonator 1' by a directional stripline coupler $K_1$ and the other end of bypass line UL is coupled to point 1' of resonator 4' by a directional stripline coupler $K_4$. The bypass line UL and directional couplers $K_1$, $K_4$ create attenuation poles displaced from the center frequency of the stripline filter by ±70 MHz.

The relative bandwidth of the filter is 15%, the largest directional coupler length is less than $\lambda/4$, and the maximum coupler width $w_c$ is less than 2.6 the conductor width $w_r$ of one resonator.

This filter structure, based on a carrier substrate which has a relative dielectric constant of 9.8 and a thickness of 25 mil, is dimensioned as follows. The resonator conductors have a width $w_r=0.6$ mm, the coupler $K_{2'3'}$ has a width $w_c=1.554$ mm and a gab width $g_1=0.354$ mm, the couplers $K_{1'2'}$ and $K_{3'4'}$ have a width $w_{c2}=0.804$ mm and a gap width $g_2=0.124$ mm, the couplers $K_1$ and $K_4$ have a width $w_{c3}=0.825$ mm and a gap width $g_3=0.145$ mm and the bypass line UL has a width $w_{UL}=0.34$ mm.

Figure 6:
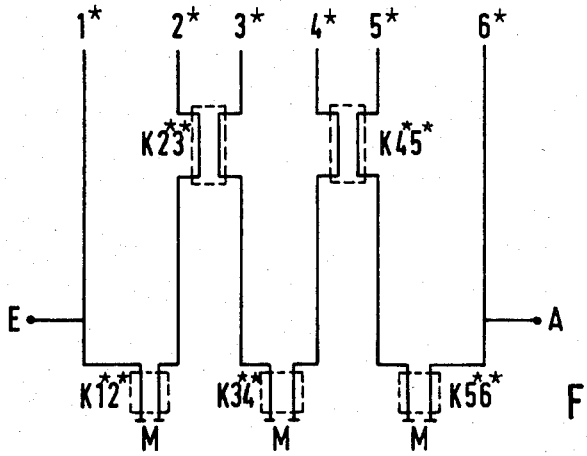
FIG. 6 is an equivalent circuit diagram for the embodiment of FIG. 5.

FIGS. 5 and 6 show a six-circuit stripline filter suitable for operation at 70 MHz wherein the resonators are mounted on a 2.5"×2.5" barium tetratitanate substrate. The resonators 1*, 2*, 3*, 4*, 5* and 6*, analogous to resonators 1, 2, 3 and 4 of FIGS. 1 and 2 and 1', 2', 3' and 4' of FIGS. 3 and 4, are formed by striplines having a length equal to $\lambda/4$, and the couplings between the resonators, again analogous to similar components of FIGS. 1–4, are formed of directional stripline couplers $K_{1*2*}$, $K_{2*3*}$, $K_{3*4*}$, $K_{4*5*}$ and $K_{5*6*}$. The relative bandwidth of this filter is 11%, the maximum coupler length is less than $\lambda/22$ and the maximum coupler width $w_c$ is less than twice the width $w_r$ of the conductor of a resonator.

This filter structure, based on a carrier substrate which has a relative dielectric constant of 37 and a thickness of 25 mil, is dimensioned as follows. The resonator conductors have a width $w_r=0.5$ mm and the couplers $K_{1*2*}$, $K_{2*3*}$, $K_{3*4*}$, $K_{4*5*}$, and $K_{5*6*}$ have a width $w_c=0.926$ mm and a gap width $g_1=0.146$ mm.

It will be understood that the above description of the present invention is susceptible to various modifications, changes and adaptations and the same are intended to be comprehended within the meaning and range of equivalents of the appended claims.

What is claimed is:

1. A stripline filter for operation at a predetermined frequency and having a predetermined bandwidth, comprising:

an insulating substrate having a ground conductor affixed thereto;

at least first and second tuned stripline resonators secured to a surface of said substrate and electrically connected to said ground conductor, each of said tuned stripline resonators comprising a conductor resonating at one-quarter of the wave length corresponding to said predetermined frequency; and a directional stripline coupler having first and second spaced conductors, at least the first conductor of said directional stripline coupler being formed of a part of said first tuned stripline resonator conductor and having an electrical length which is substantially less than the total length of said first tuned resonator.

2. A stripline filter as defined in claim 1 wherein the first conductor of said directional stripline coupler has an electrical length which is less than one-half the total length of said first stripline resonator.

3. A stripline filter as defined in claim 1 wherein the first conductor of said directional stripline coupler has an electrical length which is less than the product of said predetermined bandwidth and twice the total electrical length of said first tuned stripline resonator.

4. A stripline filter as defined in claim 2 wherein the first conductor of said directional stripline coupler has an electrical length which is less than the product of said predetermined bandwidth and twice the total electrical length of said first tuned stripline resonator.

5. A stripline filter as defined in claim 1 wherein the width of said directional stripline coupler is less than 2.6 times the width of said tuned stripline resonator.

6. A stripline filter as defined in claim 1 wherein the spacing between the spaced conductors of said directional stripline coupler is substantially less than the width of one of said spaced conductors.

7. A stripline filter as defined in claim 6 wherein said spacing is less than one-half the width of said spaced conductor.

8. A stripline filter as defined in claim 1 wherein at least part of a conductor is folded.

9. A stripline filter as defined in claim 8 wherein said folded conductor forms at least part of said directional stripline coupler.

10. A stripline filter as defined in claim 1 wherein 2said directional stripline coupler couples said first and second tuned stripline resonators.

11. A stripline filter as defined in claim 1 which further comprises a folded bypass line, said folded bypass line being coupled to said first and second tuned stripline resonators by directional stripline couplers.

12. A stripline filter as defined in claim 1 wherein said tuned stripline resonators and directional stripline couplers are in the form of thin film circuits deposited on said substrate.

13. A stripline filter for operation at a predetermined frequency, comprising:

an insulating substrate having a ground conductor affixed thereto;

first, second, third and fourth stripline resonator conductors, each having a width $w_r$ and resonating at one-quarter of the wavelength corresponding to said predetermined frequency, secured to a surface of said substrate and being electrically connected to said ground conductor, portions of at least two of said stripline resonator conductors being spaced from each other by a distance less than 0.6 $w_r$ to form a directional stripline coupler, the length of the portions of said stripline resonator conductors forming said directional stripline coupler being less than one-half the total length of a stripline resonator conductor; and input and output terminals coupled to said first and fourth tuned stripline resonators respectively.

14. A stripline filter as defined in claim 13 wherein portions of said first and second stripline resonator conductors and portions of said third and fourth resonator conductors respectively are spaced from each other by a distance less than 0.6 $w_r$ to form first and second directional stripline couplers, and wherein a third directional stripline coupler couples said second and third stripline resonator conductors.

15. A stripline filter as defined in claim 13 wherein portions of said second and third stripline resonator conductors are spaced from each other by a distance less than 0.6 $w_r$ to form a first directional stripline coupler, and wherein second and third directional stripline couplers couple said first and second stripline resonator conductors and said third and fourth stripline resonator conductors respectively.

16. A stripline conductor as defined in claim 13 which further comprises fifth and sixth stripline resonator conductors each having a width $w_r$ secured to said substrate and electrically connected to said ground conductor, each of said fifth and sixth tuned stripline resonator conductors resonating at one-quarter of the wavelength corresponding to said predetermined frequency, and wherein portions of said first and second, second and third, third and fourth, fourth and fifth, and fifth and sixth stripline resonator conductors are respectively spaced from each by a distance less than 0.6 $w_r$ to form first, second, third, fourth and fifth directional stripline couplers coupling said first and second, second and third, third and fourth, fourth and fifth and fifth and sixth stripline resonator conductors respectively.

* * * * *